United States Patent [19]

Ellis et al.

[11] Patent Number: 4,602,986

[45] Date of Patent: Jul. 29, 1986

[54] ELECTROCHEMICAL CONVERSION OF OLEFINS TO OXYGENATED PRODUCTS

[75] Inventors: Keith G. Ellis, Kingston; Mahmood N. Mahmood, Walton-on-Thames, both of England

[73] Assignee: The British Petroleum Company P.L.C., London, England

[21] Appl. No.: 654,637

[22] Filed: Sep. 25, 1984

[30] Foreign Application Priority Data

Sep. 29, 1983 [GB] United Kingdom ..... 8326125

[51] Int. Cl.[4] ..... C25B 3/02

[52] U.S. Cl. ..... 204/78; 204/79; 204/80

[58] Field of Search ..... 204/59 R, 80, 78, 79

[56] References Cited

U.S. PATENT DOCUMENTS

| | | | |
|---|---|---|---|
| 3,288,692 | 11/1966 | Leduc | 204/80 |
| 3,329,593 | 7/1967 | Griffin | 204/80 |
| 3,379,626 | 4/1968 | Heuse | 204/80 |
| 4,329,208 | 5/1982 | Vayenas | 204/80 |

*Primary Examiner*—John F. Niebling

*Attorney, Agent, or Firm*—Brooks Haidt Haffner & Delahunty

[57] ABSTRACT

Accordingly, the present invention is a process for the electrochemical conversion of an olefinic compound in its gaseous phase to an oxygenated derivative thereof in an electrochemical cell comprising an anode, a cathode and an electrolyte solution characterized in that the conversion of the olefinic compound to the oxygenated derivative occurs within the electrolyte solution in a gas diffusion electrode.

14 Claims, No Drawings

ELECTROCHEMICAL CONVERSION OF OLEFINS TO OXYGENATED PRODUCTS

The present invention relates to the electrochemical conversion of olefins to oxygenated products and in particular to the use of gas diffusion electrodes for conversion of olefins to epoxides or glycol ethers.

Olefin oxides, especially ethylene oxide and propylene oxide are valuable chemical intermediates. One of the major uses of ethylene oxide and propylene oxide is in the production of glycol ethers by the base catalysed reaction of the epoxide with an alcohol. Ethylene oxide has hitherto been produced by vapour phase oxidation of ethylene with molecular oxygen in the presence of a silver catalyst at a temperature of 250°-300° C. and a pressure of 10-30 atmospheres. These relatively severe conditions can lead to the complete oxidation of the olefin to oxides of carbon especially in the case of olefins such as propylene.

The two major industrial routes to propylene oxide in use today are the chlorohydrin process using lime slurry (cf Fyvie, A. C., Chem. Ind. (Lond.) 384, 1964) and the "Arco" process (cf Landau, C., Chem. Tech. October 1979, 602). The reaction scheme for the chlorohydrin route is:

$$Cl_2+H_2O \rightarrow HOCl+HCl \quad \text{(i)}$$

$$H_2C{=}CHCH_2+HOCl \rightarrow H_2C(Cl)-CH(OH)CH_3 \quad \text{(ii)}$$

$$2CH_3CH(OH)-CH_2(Cl) + Ca(OH)_2 \longrightarrow 2\underset{\underset{O}{\backslash\,/}}{CH_2CHCH_3} + CaCl_2 + 2H_2O \quad \text{(iii)}$$

Typical reaction conditions are a temperature of 35° C. and atmospheric pressure. The major organic by-product is 1,2-dichloropropane. The great drawback of this system is the large quantity of dilute aqueous calcium chloride solution produced (approximately 40 tons of 5% calcium chloride solution per ton of propylene oxide) which presents a severe disposal problem.

Two versions of the "Arco" process involve the reaction of propylene with hydroperoxides formed from isobutane or ethyl benzene. The resulting products are propylene oxide with either tertiary butanol or methyl benzyl alcohol depending on the starting hydroperoxide. Problems associated with theis method are the recovery of the soluble metal catalyst, e.g. molybdenum naphthenate from the reaction mixture and the separation of the products and reactants.

In order to overcome the disadvantages inherent in the above processes electrochemical methods have been considered.

The accepted mechanism for the indirect electrochemical route via electrogenerated bromine is believed to involve a multi-step homogeneous reaction between electrochemically-generated bromine, water and the unsaturated hydrocarbon as shown below:

$$\text{Anode: } 2Br^- \rightarrow Br_2+2e^- \quad \text{(iv)}$$

$$\text{Bulk of solution: } Br_2+H_2O \rightleftharpoons HOBr+HBr \quad \text{(v)}$$

$$HOBr+CH_2{=}CHCH_3 \rightarrow CH_2(Br)-CH(OH)CH_3^{\oplus} \quad \text{(vi)}$$

The bromohydrin is converted to the epoxide by another homgeneous reaction which is catalysed by hydroxide ions electrochemically generated at the cathode.

$$\text{Cathode: } 2H_2O+2e^- \rightarrow H_2+2OH^- \quad \text{(vii)}$$

$$\text{Bulk of solution: } CH_2(Br)-CH(OH)CH_3 + OH^- \longrightarrow \underset{\underset{O}{\backslash\,/}}{CH_2CHCH_3} + H_2O + Br^-$$

The bromide consumed in step (iv) is regenerated in steps (v) and (viii) and the overall reaction can be represented by:

$$CH_2{=}CHCH_3 + H_2O \xrightarrow{\text{electricity}} \underset{\underset{O}{\backslash\,/}}{CH_2CHCH_3} + H_2 \quad \text{(ix)}$$

propylene oxide

The great advantage of this electrochemical method over the conventional chlorohydrin process is that the halide is recycled and is not lost as $CaCl_2$ in the elimination step (vii). In addition, the electrochemical route is very selective to propylene oxide and does not produce large amounts of co-product which can complicate the subsequent product separation step as in the "Arco" process.

A number of electrochemical cell designs for olefin oxide production have appeared in the literature from companies such as Pullman-Kellogg (GB No. 1,064,961), Bayer (German Patent No. 1252649), BASF (DOS No 2336288) and from academic institutions (e.g. GB No. 1,504,690). However, all these cell designs suffer from two basic drawbacks: (a) the relatively low production rate of propylene oxide due to the low solubility of proylene in aqueous electrolytes and (b) the need to separate the recycle propylene from the cathodically generated hydrogen.

A further electrochemical method described in U.S. Pat. No. 3,427,235 uses a porous anode having a catalyst deposited thereon and electrogenerated atomic oxygen is claimed to convert the olefin to the epoxide. In this method the olefin is introduced into the cell by bubbling it through the porous anode to be dispersed into the electrolyte. The reaction products include the olefin oxide which remains in the electrolyte and the unreacted olefin and hydrogen bubbles through the electrolyte to be recovered above the surface of the electrolyte. In this case the problem of separating the cathodically generated hydrogen from the olefin is solved by interposing a diaphragm between the anode and the cathode.

A similar type of diaphragm cell in which the olefin is oxidised by an indirect route, i.e. the olefin is first converted to its halohydrin and then to the olefin oxide is described in an earlier filed U.S. Pat. No. 3,342,717. In this case too the olefin is bubbled through a porous anode to be dispersed into the electrolyte and a diaphragm is used to separate the hydrogen from unreacted propylene.

U.S. Pat. No. 3,720,597 discloses a multiporosity electrode which can be used for electrochemical conversions such as the electrochemical fluorination of hydrocarbons. The reaction is carried out within the confines of a porous electrode element in which the pores of the lower portion of the electrode element has a lower effective size than the upper portion. However, unlike the process of the present invention, the anode reaction products and unreacted feedstock exit together at the top of the anode and can mix with the reaction products from the cathode. Thus, either a partition or a specially designed electrode having a passageway through the body of the electrode must be employed to separate the anode products from the cathode products, and more specifically, the unreacted feedstock from the cathode products.

None of the references reviewed above mitigate the problems of either separating anode products from unreacted feedstock or separating cathode products from anode products without the use of a separating means such as a diaphragm or a specially designed electrode.

It has now been found that the use of a separator means to separate oxygenated products (i.e. epoxide) and unreacted feedstock (i.e. olefin) from cathode products (i.e. hydrogen) can be avoided and the process can be operated at a higher effective current densities by using a gas diffusion electrode for the conversion of olefins to oxygenated derivatives thereof.

Accordingly, the present invention is a process for the electrochemical conversion of an olefinic compound in its gaseous phase to an oxygenated derivative thereof in an electrochemical cell comprising an anode, a cathode and an electrolyte solution characterised in that the conversion of the olefinic compound to the oxygenated derivative occurs within the electrolyte solution in a gas diffusion electrode.

By "gas diffusion electrode" is meant in the context of the present invention an electrode in which the gaseous reactant is not sparged through the electrode to be dispersed into solution but is substantially contained within the body of the porous electrode so that one side of the electrode is kept dry. This is the so called dry side of the electrode. The side of the electrode in contact with the electrolyte solution is the so called wet side.

Using the gas diffusion electrode, the reaction occurs in the electrolyte solution at the meniscus within the pores of the electrode at which a three-phase interface between the reactant gas, electrolyte solution and electrode is established. The unreacted olefin is removed as a gas from the dry side of the electrode and is not admixed with the gas electrogenerated at the counter electrode. Of course, if the conditions employed are not optimum, a small amount of reactant may diffuse into the electrolyte. However, the unreacted olefin is kept substantially within the dry side of the electrode.

When the reaction product (olefin oxide) is miscible in the electrolyte solution, it is removed through the wet side of the electrode and can be collected through any suitable means.

The reactant olefin and its interface with the electrolyte solution is primarily contained within the body of the porous electrode at which olefin conversion occurs by controlling the pressure difference across the electrode between the dry and wet side. The precise pressure necessary to maintain a meniscus will depend not only upon the olefin but also on the pore size of the gas diffusion electrode, the electrode material, the density of the electrolyte used and the solvent.

The gas diffusion electrode is preferably located to physically separate the reaction vessel or cell into a dry zone in contact with the dry side of the electrode and a wet zone in contact with the wet side of the electrode. For example, the electrode could be placed in the centre of the cell dividing it into two halves. One half would be the dry zone and the other half would be the wet zone.

The gas diffusion electrode is suitably of a material such as carbon or graphite. Preferably, the gas diffusion electrode will have a pore distribution which is substantially uniform throughout the electrode.

The electrode can also be a flexible substrate coated or impregnated with a conductive material.

For example, the electrode may be made of carbon cloth or felt or fabricated from compressed mixtures of carbon powder with a polymeric particulate binder such as polytetrafluoroethylene (PTFE) with or without a solvent. If necessary, a pore forming agent such as ammonium carbonate may also be added to the mixture. The mixture is suitably compressed at a temperature of 50°14 500° C., preferably from 200°–400° C. and a pressure of 1 to 60 bar preferably 2–30 bar. The solvent may be removed from the mixture prior to or during compression. The electrodes thus produced suitably have a loading of 20–400 mg/cm$^2$, preferably from 30–200 mg/cm$^2$.

Where PTFE is used as a binder, the electrode sheets suitably have 10–70% w/w of PTFE based on the total dry weight of carbon and PTFE.

Carbon cloth is typically produced by the heat treatment and subsequent carbonisation of rayon based yarn or cloth although other techniques can be used.

The counter-electrode in the electrochemical cell may be of any conventional type such as graphite, titanium, aluminium, copper, iron, nickel, cadmium, stainless steel and the like which may be further catalysed as necessary.

The gas diffusion electrode described above may be used either as the anode or as the cathode, or both depending upon the nature of the oxidising agent used. For instance, if the conversion of the olefin to the oxygenated derivative is carried out using electrogenerated halogen as the oxidising agent then the conversion occurs at the anode which will be a gas diffusion anode according to the present invention. On the other hand, if the conversion of the olefin is carried out using electrogenerated hydrogen peroxide as the oxidising agent, then the conversion occurs at the cathode which will then be a gas diffusion cathode.

The olefinic compounds useful herein have at least one aliphatic or cycloaliphatic carbon to carbon double bond at which the reaction occurs. Thus the olefinic compound may be a straight or branched chain, acyclic, alicyclic or a cycloaliphatic compound or combination thereof in which the carbon to carbon double bond may be in a terminal or an internal position. The olefinic compounds may also carry substituents which do not interfere with the conversion reaction. Examples of olefinic compounds which may be epoxidised by the process of the present invention include olefins of the homologous series $C_nH_{2n}$ in which n is an integer from 2 to 8. Such olefinic compounds include ethylene, propylene, butylene, pentene, hexene, heptene, octene and their isomers; cyclic olefins such as cyclopentene and cyclohexene; dienes whether the double bonds are isolated or conjugated; and substituted olefinic compounds such as allyl chloride and styrenes.

Whichever olefinic compound is used, it is essential that the compound is introduced into the cell in the vapour phase on the dry side of the gas diffusion electrode. In this manner, the olefin reactant is contained substantially within the dry side of the porous electrode and the reaction primarily occurs at the meniscus within the pores of the electrode at which a three-phase interface between the gas, electrolyte solution and electrode is established.

The conversion of the olefinic compound to its oxygenated derivative may be carried out directly at the anode, or indirectly at the cathode or the anode using an electrogenerated oxidising agent.

Direct conversion of the olefin to its oxygenated derivative may require the presence of catalytic components such as manganese, molybdenum, vanadium, tungsten or chromium.

The oxidising agent can be any material capable of accepting electrons through redox reactions and preferably one which can be generated electrolytically in situ. For example, indirect oxidising agents include but are not limited to the halogens electrogenerated from the corresponding halides e.g. chloride or bromide, and hydrogen peroxide electrogenerated by the cathodic reduction of oxygen. Multivalent metals may also be used as the oxidising agent depending on the reactants and conditions employed.

No catalysts are usually necessary if indirect oxidising agents such as halogens are used which convert the olefin to the corresponding halohydrin in the first stage of the conversion. If, however, the indirect oxidising agent is electrogenerated hydrogen peroxide it may be necessary to use a gas diffusion cathode containing a catalytic component such as e.g. molybdenum, rhenium, platinium or osmium.

Where the conversion of the olefin is carried out by direct oxidation, the electrolyte used is dissolved in an appropriate solvent. For instance, the electrolyte may comprise a water-soluble salt which is dissolved in an aqueous medium but does not interfere with the olefin conversion reaction. Examples of such electrolytes include but are not limited to alkali metal salts such as the alkali metal sulphates and hydroxides, and tetraalkyl ammonium salts.

Where the conversion of the olefin is carried out indirectly using electrogenerated oxidising agent such as a halogen, a corresponding salt such as a halide salt is used as the electrolyte and dissolved in water, an organic solvent, e.g. an aliphatic alcohol such as methanol or ethanol, or mixtures thereof at an appropriate pH value.

The oxygenated derivatives produced herein can be epoxides, aldehydes, alcohols, carboxylic acids, ethers, ketones or mixtures thereof of the corresponding olefinic compounds. Preferably, the oxygenated derivatives are epoxides, ethers or combinations thereof. For example, if the solvent used to dissolve the electrolyte (i.e. alkali metal salts) is water along, the conversion product is an epoxide whereas with an aqueous alcoholic solvent, glycol ethers are also produced.

The olefin conversion can be carried out at a variety of temperatures depending on the solubility and vaporation temperatures of the reactants and products. The conversion is suitably carried out at a temperature from 10° to 150° C.

Pressures can also vary widely and can range from atmospheric to superatmospheric. Pressures from 1 to 30 atmospheres are suitable with pressures of 1 to 20 atmospheres being preferred.

The present invention is further illustrated with reference to the following examples and comparative tests. It is to be understood that the scope of this invention includes equivalent embodiments, variations and modifications which fall within the scope of the attached claims.

EXAMPLES

The following general methods of electrode preparation (A) and electrochemical epoxidation of propylene (B) were used:

A. Electrode Preparation

Teflon (a registered trademark) bonded gas diffusion electrodes were prepared by pressing mixtures of carbon powder (Vulcan XC-72) and PTFE dispersion (GP1, ICI Plastics Division) at elevated temperatures. Ammonium carbonate was added as pore forming agent where indicated. The solvents used during the mixing process were removed prior to pressing.

The resulting electrode sheets had PTFE contents ranging from 14% to 70% by weight of both dry components.

Electrodes of the required size were then cut from the sheets.

Carbon cloth gas diffusion electrodes used were prepared by cutting carbon cloth (Union Carbide VCK grade) to the required size and using one or more layers of cloth directly as the electrode.

B. Electrochemical Epoxidation of Propylene

Electrolyses were carried out batchwise in an electrochemical cell with a gas diffusion anode and a graphite plate cathode.

The electrolyte solution used consisted of alkali metal bromide in aqueous solution (0.3M) and the pH value of the solution was adjusted to 11.

A constant current was passed through the cell and propylene gas was fed to the dry side of the gas diffusion anode. The flow rate and pressure of propylene gas was monitored by a rotameter (Flowbits) and a water manometer respectively. The off gases from the cell were passed through a cold trap and then vented.

The electrolyte solution was vigorously stirred during electrolysis by means of a magnetic stirrer.

The products from the reaction were analysed periodically by gas chromatography.

EXAMPLE 1

A teflon (RTM) bonded gas diffusion electrode was made from a mixture of PTFE (40% w/w) and carbon powder (Vulcan XC-72, 60% w/w) with a small amount of ammonium carbonate as pore former (10% w/w). This mixture was pressed at 200° C. and 3.10 bar and the resulting electrode sheet was used as the anode in the cell described in (B) above.

The cell was operated at a constant current density of 100 mA/cm$^2$ at a temperature of 25° C. and the electrolyte solution was 0.3M aqueous sodium bromide solution. Propylene was fed to the dry side of the gas diffusion anode at a flow rate of 15 ml/min and did not disperse into the electrolyte solution. Under these conditions propylene oxide was produced with a current efficiency of 64%.

COMPARATIVE TEST 1

In a comparative test (not according to the invention) the gas diffusion anode of Example 1 was substituted by an ordinary carbon plate anode and propylene was sparged into the electrolyte solution of aqueous 0.3M sodium bromide solution (pH 11) at a flow rate of 15 ml/min. At a current density of 100 mA/cm$^2$ propylene oxide was produced with a current efficiency of 28%.

The results of Example 1 and Comparative Test 1 show that use of a teflon (RTM) bonded gas diffusion electrode for propylene epoxidation results in a more than two-fold increase in the rate of olefin conversion to the epoxide at a current density of 100 mA/cm$^2$.

EXAMPLE 2

A carbon cloth (Union Carbide VCK grade) gas diffusion anode was used in the cell described in (B) above. The cell was operated at a constant current density of 150 mA/cm$^2$ at a temperature of 25° C. The electrolyte solution was 0.3M aqueous sodium bromide solution (pH 11). Propylene was fed to the dry side of the gas diffusion anode at a flow rate of 15 ml/min and a pressure differential of 6 cm$H_2O$ between the electrode wet and dry side. The gas did not disperse into the electrolyte solution. Under these conditions propylene oxide was produced with a current efficiency of 74%.

COMPARATIVE TEST 2

In a comparative test (not according to the invention) propylene was fed directly through the carbon cloth anode of Example 2 and sparged into the electrolyte solution (pH 11) containing 0.3M sodium bromide. The current efficiency obtained was only 42% at a current density of 150 mA/cm$^2$.

The results of Example 2 and Comparative Test 2 show that the high current efficiencies at high current density obtained using gas diffusion electrodes are due to an effect of the gas diffusion electrode which approximately give a two-fold increase in the rate of propylene epoxidation over comparable cells in which propylene is dispersed or sparged through the anode or directly into the electrolyte solution.

EXAMPLE 3

The use of a gas diffusion electrode for the in-situ conversion of an olefin to a glycol ether is demonstrated below. A carbon cloth gas diffusion anode was used as in Example 2 above in an electrochemical cell which contained a solution of 0.3M sodium bromide in a mixture of methanol (50% w/w) and distilled water (50% w/w) with the pH adjusted to 11. The cell was operated at a constant current density of 150 mA/cm$^2$ and a temperature of 25° C. Propylene was fed to the dry side of the gas diffusion anode but was not allowed to disperse into the electrolyte solution. The major products of this electrochemical reaction were propylene oxide and 1-methoxy-2-propanol.

We claim:

1. A process for the electrochemical conversion of an olefinic compound in its gaseous phase to an oxygenated derivative thereof in an electrochemical cell comprising an anode, a cathode and an electrolyte solution characterised in that the conversion occurs in the electrolyte solution within a gas diffusion electrode, and said electrode being an electrode in which the gaseous olefin reactant is not sparged through the electrode to be dispersed into solution but is substantially contained within the body of the electrode.

2. The process of claim 1 wherein the electrolyte solution comprises a solvent which is water, an alcohol or mixtures thereof.

3. The process of claim 1 wherein the gas diffusion electrode comprises carbon, graphite or carbon cloth.

4. The process of claim 1 wherein the conversion occurs in the presence of an oxidising agent electrogenerated in situ.

5. The process of claim 4 wherein the oxidising agent is a halogen electrogenerated from the corresponding halide.

6. The process of claim 1 wherein the conversion occurs in the presence of a catalytic component.

7. The process of claim 1 wherein the olefinic compound are olefins of the homologous series $C_nH_{2n}$ in which n is an integer from 2 to 8.

8. The process of claim 1 wherein the oxygenated derivatives are epoxides, ethers, or mixtures thereof.

9. The process of claim 1 wherein the olefinic compound is propylene and the oxygenated derivative is propylene oxide.

10. The process of claim 1, wherein the olefinic compound is propylene and the oxygenated derivative is propylene oxide, 1-methoxy-2-propanol, or mixtures thereof.

11. A process for the electrochemical conversion of an olefinic compound in its gaseous phase to an oxygenated derivative thereof in an electrochemical cell comprising an anode, a cathode and an electrolyte solution, said conversion occurring in the electrolyte solution within a gas diffusion electrode, said gas diffusion electrode being an electrode in which the gaseous olefin reactant is not sparged through the electrode to be dispersed into solution but is substantially contained within the body of the porous electrode so that one side of the electrode is kept dry and is the dry side of the electrode, the side of the electrode in contact with the electrolyte solution is the wet side of the electrode, controlling the pressure difference across the electrode between the dry side and the wet side of the electrode, such that the reactant olefin and its interface with the electrolyte solution are primarily contained within the body of the porous electrode at which olefin conversion occurs.

12. The process of claim 11, wherein the conversion of the olefin to the oxygenated derivative is carried out using electrogenerated halogen as the oxidising agent, and said conversion occurs at the anode which is a gas diffusion anode.

13. The process of claim 11, wherein the conversion of the olefin is carried out using electrogenerated hydrogen peroxide as the oxidising agent, and said conversion occurs at the cathode which is a gas diffusion cathode.

14. The process of claim 11 wherein unreacted olefin is removed as a gas from the dry side of the electrode and the reactant olefin is contained within the body of the electrode by controlling the pressure difference across the electrode between the dry and wet side of the electrode.

* * * * *

UNITED STATES PATENT AND TRADEMARK OFFICE

CERTIFICATE OF CORRECTION

PATENT NO. : 4,602,986

DATED : July 29, 1986

INVENTOR(S) : KEITH G. ELLIS et al

It is certified that error appears in the above-identified patent and that said Letters Patent is hereby corrected as shown below:

Col. 1, line 38, Under "$2CH_2CHCH_3$" --propylene oxide-- has been omitted. $\diagdown_{0}\diagup$ Col. 1, line 51, "theis" should read --this--.

Col. 2, line 14, Under "$CH_2CHCH_3$ --propylene oxide (viii)-- $\diagdown_{0}\diagup$ has been omitted.

Col. 2, line 27, "(vii)" should read --(viii)--.

Col. 4, line 18, "50° 14 500°C" should read --50°-500°C--.

Col. 5, line 54, "along" should read --alone--

Signed and Sealed this

Twenty-third Day of December, 1986

*Attest:*

DONALD J. QUIGG

*Attesting Officer* *Commissioner of Patents and Trademarks*